US011203797B2

(12) United States Patent
Okonogi et al.

(10) Patent No.: US 11,203,797 B2
(45) **Date of Patent: *Dec. 21, 2021**

(54) STEEL WIRE AND WIRE ROD

(71) Applicant: NIPPON STEEL CORPORATION, Tokyo (JP)

(72) Inventors: Makoto Okonogi, Tokyo (JP); Shingo Yamasaki, Tokyo (JP); Akifumi Kawana, Tokyo (JP); Hideaki Gotohda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/832,725

(22) Filed: Mar. 27, 2020

(65) Prior Publication Data

US 2020/0224288 A1 Jul. 16, 2020

Related U.S. Application Data

(63) Continuation of application No. 13/816,835, filed as application No. PCT/JP2011/068350 on Aug. 11, 2011, now Pat. No. 10,704,118.

(30) Foreign Application Priority Data

Aug. 17, 2010 (JP) ..... 2010-182365

(51) Int. Cl.
*C22C 38/00* (2006.01)
*C22C 38/02* (2006.01)
(Continued)

(52) U.S. Cl.
CPC ..... *C21D 9/525* (2013.01); *C21D 8/02* (2013.01); *C21D 8/06* (2013.01); *C21D 9/0075* (2013.01);
(Continued)

(58) Field of Classification Search
CPC ..... C21D 9/525; C21D 9/0075; C21D 8/06; C21D 8/02; C21D 9/52; C21D 2211/005;
(Continued)

(56) References Cited

U.S. PATENT DOCUMENTS 6,264,759 B1 7/2001 Bae et al.
6,605,166 B2 * 8/2003 Koike ..... C21D 9/0093 148/587
(Continued)

FOREIGN PATENT DOCUMENTS

JP 62-228431 A 10/1987
JP 11-315349 A 11/1999
(Continued)

OTHER PUBLICATIONS

U.S. Appl. No. 13/816,835, filed Feb. 13, 2013.
(Continued)

*Primary Examiner* — John A Hevey
(74) *Attorney, Agent, or Firm* — Birch, Stewart, Kolasch & Birch, LLP.

(57) ABSTRACT

A predetermined composition is had, when a C content is represented by (C %), in a case of (C %) being not less than 0.35% nor more than 0.65%, a volume fraction of pearlite is 64×(C %)+52% or more, and in a case of (C %) being greater than 0.65% and 0.85% or less, the volume fraction of pearlite is not less than 94% nor more than 100%, and a structure of the other portion is composed of one or two of proeutectoid ferrite and bainite. Further, in a region to a depth of 1.0 mm from a surface, a volume fraction of pearlite block having an aspect ratio of 2.0 or more is not less than 70% nor more than 95%, and a volume fraction of pearlite having an angle between an axial direction and a lamellar direction on a cross section parallel to the axial direction of 40° or less is 60% or more with respect to all pearlite.

9 Claims, 2 Drawing Sheets

(51) Int. Cl.

| | |
|---|---|
| ***C22C 38/04*** | (2006.01) |
| ***C22C 38/06*** | (2006.01) |
| ***C22C 38/14*** | (2006.01) |
| ***C22C 38/16*** | (2006.01) |
| ***C22C 38/18*** | (2006.01) |
| ***C22C 38/08*** | (2006.01) |
| ***C22C 38/12*** | (2006.01) |
| ***C22C 38/26*** | (2006.01) |
| ***C22C 38/28*** | (2006.01) |
| ***C22C 38/32*** | (2006.01) |
| ***C22C 38/50*** | (2006.01) |
| ***C22C 38/54*** | (2006.01) |
| ***C21D 9/52*** | (2006.01) |
| ***C21D 8/02*** | (2006.01) |
| ***C21D 8/06*** | (2006.01) |
| ***C21D 9/00*** | (2006.01) |

(52) U.S. Cl.
CPC ..... *C21D 9/52* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/26* (2013.01); *C22C 38/28* (2013.01); *C22C 38/32* (2013.01); *C22C 38/50* (2013.01); *C22C 38/54* (2013.01); *C21D 2211/002* (2013.01); *C21D 2211/005* (2013.01); *C21D 2211/009* (2013.01)

(58) Field of Classification Search
CPC ..... C21D 2211/009; C21D 2211/002; C22C 38/14; C22C 38/16; C22C 38/18; C22C 38/002; C22C 38/08; C22C 38/12; C22C 38/26; C22C 38/28; C22C 38/32; C22C 38/50; C22C 38/54; C22C 38/001; C22C 38/02; C22C 38/04; C22C 38/06
See application file for complete search history.

(56) References Cited

U.S. PATENT DOCUMENTS

| | | | | |
|---|---|---|---|---|
| 8,864,920 | B2 | 10/2014 | Yamasaki et al. | |
| 9,255,306 | B2 | 2/2016 | Yamasaki et al. | |
| 10,704,118 | B2 * | 7/2020 | Okonogi | C22C 38/04 |
| 2004/0202567 | A1 | 10/2004 | Takada et al. | |
| 2006/0048864 | A1 * | 3/2006 | Nagao | C21D 8/06 148/320 |
| 2007/0187003 | A1 | 8/2007 | Takashima et al. | |
| 2009/0229711 | A1 | 9/2009 | Yamasaki et al. | |
| 2009/0277545 | A1 | 11/2009 | Yamasaki et al. | |
| 2010/0175795 | A1 | 7/2010 | Choi et al. | |
| 2010/0215539 | A1 | 8/2010 | Edelman et al. | |
| 2011/0259483 | A1 | 10/2011 | Lee et al. | |
| 2014/0290806 | A1 | 10/2014 | Okonogi et al. | |
| 2016/0129489 | A1 | 5/2016 | Okonogi et al. | |
| 2016/0145712 | A1 | 5/2016 | Okonogi et al. | |
| 2020/0354810 | A1 * | 11/2020 | Okonogi | C22C 38/02 |

FOREIGN PATENT DOCUMENTS

| | | | |
|---|---|---|---|
| JP | 2000-144306 | A | 5/2000 |
| JP | 2001-348618 | A | 12/2001 |
| JP | 2002-69579 | A | 3/2002 |
| JP | 2003-73740 | A | 3/2003 |
| JP | 2003-193183 | A | 7/2003 |
| JP | 2004-307929 | A | 11/2004 |
| JP | 2005-281860 | A | 10/2005 |
| JP | 2007-39800 | A | 2/2007 |
| JP | 2008-261027 | A | 10/2008 |
| JP | 2010-506052 | A | 2/2010 |
| JP | 2010-159476 | A | 7/2010 |
| WO | WO 2010/074463 | A2 | 7/2010 |

OTHER PUBLICATIONS

Indian Office Action for Appl. No. 1435/DELNP/2013 dated Apr. 18, 2018.
International Preliminary Report on Patentability dated Mar. 28, 2013 issued in corresponding PCT Application No. PCT/JP2011/068350.
International Search Report dated Nov. 15, 2011, issued in corresponding PCT Application No. PCT/JP2011/068350.

* cited by examiner

● HYDROGEN EMBRITTLEMENT RESISTANCE: EXCELLENT, COLD FORGEABILITY: EXCELLENT

× HYDROGEN EMBRITTLEMENT RESISTANCE: POOR, COLD FORGEABILITY: POOR

△ HYDROGEN EMBRITTLEMENT RESISTANCE: EXCELLENT, COLD FORGEABILITY: POOR

◇ HYDROGEN EMBRITTLEMENT RESISTANCE: POOR, COLD FORGEABILITY: EXCELLENT

STEEL WIRE AND WIRE ROD

CROSS-REFERENCE TO RELATED APPLICATIONS

This application is a Continuation application of co-pending application Ser. No. 13/816,835, filed on Feb. 13, 2013, which is the National Phase under 35 U.S.C. § 371 of International Application No. PCT/JP2011/068350, filed on Aug. 11, 2011, which claims the benefit under 35 U.S.C. § 119(a) to Patent Application No. 2010-182365, filed in Japan on Aug. 17, 2010, all of which are hereby expressly incorporated by reference into the present application.

TECHNICAL FIELD

The present invention relates to a steel wire of special steel and a wire rod of special steel suitable for a machine part having a tensile strength of not less than 1200 MPa nor more than 1500 MPa, manufacturing methods thereof, and so on.

BACKGROUND ART

Automobile parts and various industrial machine parts each having a shaft shape such as a bolt, a torsion bar, and a stabilizer have been manufactured from a wire rod. Then, in recent years, automobiles and various industrial machines have required a high-strength machine part having a tensile strength of 1200 MPa or more with the aim of reduction in weight and reduction in size.

However, with the achievement of high strength of a machine part, what is called a hydrogen embrittlement, in which due to the effect of hydrogen penetrated into a steel material, a machine part is fractured by stress smaller than that to be expected originally, has become noticeable. The hydrogen embrittlement appears in various forms. For example, in a bolt used for an automobile, a building, and so on, a phenomenon in which after a while since the bolt is fastened, fracture occurs suddenly, called delayed fracture, sometimes occurs.

Then, various examinations for improving hydrogen embrittlement resistance of a high-strength part have been conducted. With regard to a bolt being one example of the high-strength machine part, there has been known a technique utilizing pearlite after wire drawing, as one of techniques improving delayed fracture resistance (Patent Literatures 1 to 4).

However, even by these conventional techniques, it is difficult to improve the hydrogen embrittlement resistance in the high-strength machine part having a tensile strength of 1200 MPa or more. Further, a steel wire and a wire rod suitable for such a machine part are not also invented.

CITATION LIST

Patent Literature

Patent Literature 1: Japanese Laid-open Patent Publication No. 2005-281860

Patent Literature 2: Japanese Laid-open Patent Publication No. 2001-348618

Patent Literature 3: Japanese Laid-open Patent Publication No. 2004-307929

Patent Literature 4: Japanese Laid-open Patent Publication No. 2008-261027

Patent Literature 5: Japanese Laid-open Patent Publication No. 11-315349

Patent Literature 6: Japanese Laid-open Patent Publication No. 2002-69579

Patent Literature 7: Japanese Laid-open Patent Publication No. 2000-144306

SUMMARY OF INVENTION

Technical Problem

The present invention has an object to provide a steel wire of special steel and a wire rod of special steel that have high strength and are capable of improving hydrogen embrittlement resistance, manufacturing methods thereof, and so on.

Solution to Problem

The gist of the present invention is as follows.

(1)

A steel wire of special steel containing:

in mass %;

C: 0.35% to 0.85%;

Si: 0.05% to 2.0%;

Mn: 0.20% to 1.0%; and

Al: 0.005% to 0.05%, a P content being 0.030% or less, a S content being 0.030% or less, and a balance being composed of Fe and inevitable impurities, wherein when a C content is represented by (C %), in a case of (C %) being not less than 0.35% nor more than 0.65%, a volume fraction of pearlite is 64×(C %)+52% or more, and in a case of (C %) being greater than 0.65% and 0.85% or less, the volume fraction of pearlite is not less than 94% nor more than 100%, and a structure of the other portion is composed of one or two of proeutectoid ferrite or bainite, in a region up to a depth of 1.0 mm from a surface of the steel wire, a volume fraction of pearlite block having an aspect ratio of 2.0 or more is not less than 70% nor more than 95%, and a volume fraction of pearlite having an angle between an axial direction of the steel wire and a lamellar direction of the perlite on a cross section parallel to the axial direction of 40° or less is 60% or more with respect to all pearlite, and a tensile strength is 1200 MPa or more and less than 1500 MPa.

(2)

The steel wire of special steel according to (1), wherein, in mass %, a N content is 0.0050% or less.

(3)

The steel wire of special steel according to (1) or (2), further containing, in mass %, one or two of Cr: 0.02% to 1.0% and Ni: 0.02% to 0.50%.

(4)

The steel wire of special steel according to any one of (1) to (3), further containing, in mass %, one or two or more of Ti: 0.002% to 0.050%, V: 0.01% to 0.20%, or Nb: 0.005% to 0.100%.

(5)

The steel wire of special steel according to any one of (1) to (4), further containing, in mass %, B: 0.0001% to 0.0060%.

(6)

The steel wire of special steel according to any one of (1) to (5), further containing, in mass %, one or two or more of Ca: 0.001% to 0.010%, Mg: 0.001% to 0.010%, or Zr: 0.001% to 0.010%.

(7)

A wire rod of special steel containing:

in mass %;

C: 0.35 to 0.85%;

Si: 0.05 to 2.0%;

Mn: 0.20 to 1.0%;

P: 0.030% or less;

S: 0.030% or less; and

Al: 0.005 to 0.05%, a balance being composed of Fe and inevitable impurities, wherein when a C content is represented by (C %), in a case of (C %) being not less than 0.35% nor more than 0.65%, a volume fraction of pearlite is 64×(C %)+52% or more, and in a case of (C %) being greater than 0.65% and 0.85% or less, the volume fraction of pearlite is not less than 94% nor more than 100%, and a structure of the other portion is composed of one or two of proeutectoid ferrite and bainite.

(8)

The wire rod of special steel according to (7), wherein, in mass %, a N content is 0.0050% or less.

(9)

The wire rod of special steel according to (7) or (8), further containing, in mass %, one or two of Cr: 0.02% to 1.0% and Ni: 0.02% to 0.50%.

(10)

The wire rod of special steel according to any one of (7) to (9), further containing, in mass %, one or two or more of Ti: 0.002% to 0.050%, V: 0.01% to 0.20%, or Nb: 0.005% to 0.100%.

(11)

The wire rod of special steel according to any one of (7) to (10), further containing, in mass %, B: 0.0001% to 0.0060%.

(12)

The wire rod of special steel according to any one of (7) to (11), further containing, in mass %, one or two or more of Ca: 0.001% to 0.010%, Mg: 0.001% to 0.010%, or Zr: 0.001% to 0.010%.

(13)

A manufacturing method of a steel wire of special steel comprising:

performing hot rolling of a billet with a temperature of finish rolling being not lower than 800° C. nor higher than 950° C. so as to obtain a steel material having a grain size number of austenite grains being 8 or more;

next, immersing the steel material having a temperature of not lower than 750° C. nor higher than 950° C. in a first molten salt bath having a temperature of not lower than 400° C. nor higher than 600° C. and isothermally holding the steel material for not shorter than 5 seconds nor longer than 150 seconds;

next, immersing the steel material in a second molten salt bath having a temperature of not lower than 500° C. nor higher than 600° C. and isothermally holding the steel material for not shorter than 5 seconds nor longer than 150 seconds; and next, performing wire drawing with a total reduction of area of not less than 25% nor more than 80% on the steel material at room temperature, wherein the steel material contains:

in mass %;

C: 0.35% to 0.85%;

Si: 0.05% to 2.0%;

Mn: 0.20% to 1.0%; and

Al: 0.005% to 0.05%, a P content being 0.030% or less, a S content being 0.030% or less, and a balance being composed of Fe and inevitable impurities.

(14)

The manufacturing method of the steel wire of special steel according to (13), wherein a reduction of area at the final of the wire drawing is not less than 1% nor more than 15%.

(15)

A manufacturing method of a wire rod of special steel comprising:

performing hot rolling of a billet with a temperature of finish rolling being not lower than 800° C. nor higher than 950° C. so as to obtain a steel material having a grain size number of austenite grains being 8 or more;

next, immersing the steel material having a temperature of not lower than 750° C. nor higher than 950° C. in a first molten salt bath having a temperature of not lower than 400° C. nor higher than 600° C. and isothermally holding the steel material for not shorter than 5 seconds nor longer than 150 seconds; and next, immersing the steel material in a second molten salt bath having a temperature of not lower than 500° C. nor higher than 600° C. and isothermally holding the steel material for not shorter than 5 seconds nor longer than 150 seconds, wherein the steel material contains:

in mass %;

C: 0.35% to 0.85%;

Si: 0.05% to 2.0%;

Mn: 0.20% to 1.0%; and

Al: 0.005% to 0.05%, a P content being 0.030% or less, a S content being 0.030% or less, and a balance being composed of Fe and inevitable impurities.

(16)

A machine part containing:

in mass %;

C: 0.35% to 0.85%;

Si: 0.05% to 2.0%;

Mn: 0.20% to 1.0%; and

Al: 0.005% to 0.05%;

a P content being 0.030% or less;

a S content being 0.030% or less; and a balance being composed of Fe and inevitable impurities, wherein when the C content is represented by (C %), in a case of (C %) being not less than 0.35% nor more than 0.65%, a volume fraction of pearlite is 64×(C %)+52% or more, and in a case of (C %) being greater than 0.65% and 0.85% or less, the volume fraction of pearlite is not less than 94% nor more than 100%, and a structure of the other portion is composed of one or two of proeutectoid ferrite and bainite, in a region up to a depth of 1.0 mm from a surface of the machine part, a volume fraction of pearlite block having an aspect ratio of 2.0 or more is not less than 70% nor more than 95%, and a volume fraction of pearlite having an angle between an axial direction of the machine part and a lamellar direction of the perlite on a cross section parallel to the axial direction of 40° or less is 60% or more with respect to all pearlite, and a tensile strength is 1200 MPa or more and less than 1500 MPa.

Advantageous Effects of Invention

According to the present invention, it is possible to significantly improve hydrogen embrittlement resistance while obtaining high strength. Further, in significantly improving the hydrogen embrittlement resistance, particularly, a significant increase in manufacturing cost is also not needed.

DESCRIPTION OF EMBODIMENTS

Figure 1:
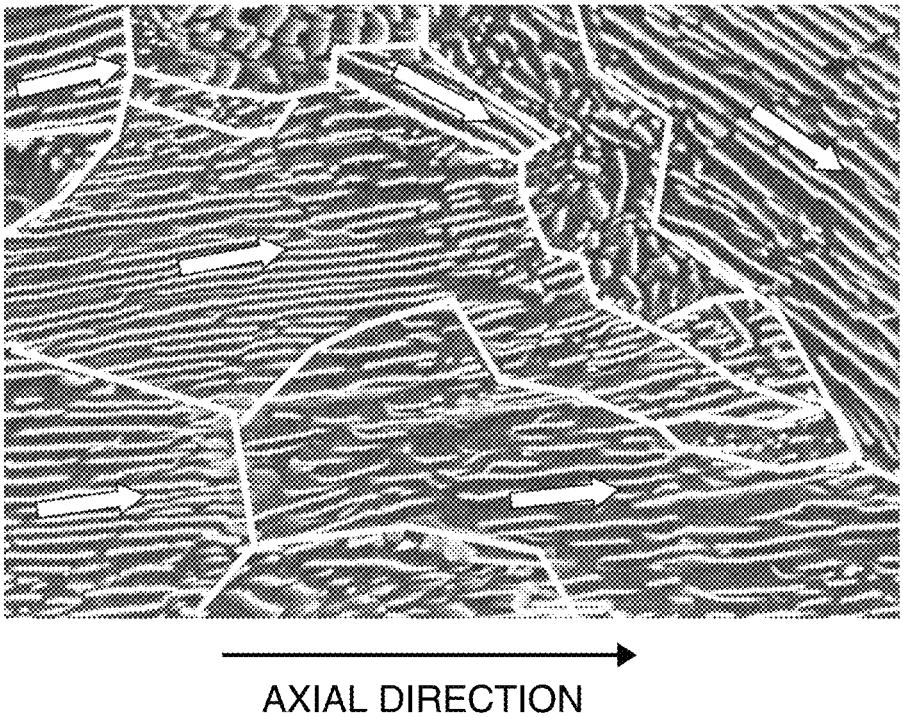
FIG. 1 is a view illustrating a relationship between an axial direction and a lamellar direction.

The present inventors investigated effects of components and structures on hydrogen embrittlement resistance of a high-strength machine part having a tensile strength of 1200 MPa or more in detail, and found components and structures for obtaining the excellent hydrogen embrittlement resistance. Further, as a result of repeated examinations of a method for obtaining the components and the structures based on metallurgical knowledge, the following facts became clear. Incidentally, the unit "%" of content of each of the components in the following explanation means "mass %."

First, a structure of a machine part will be explained.

It is effective to elongate pearlite block in a surface portion of a machine part in an orientation parallel to the surface in order to obtain an excellent hydrogen embrittlement resistance. Further, it is also effective to align an orientation of a lamellar layer of pearlite having a layer structure of ferrite and cementite with the orientation parallel to the surface. Here, the pearlite block, of which the detail will be described later, is a unit of pearlite made of ferrite and cementite having an aligned orientation, in general.

Concretely, in a case when in a region up to a depth of 1.0 mm from the surface (surface portion), a volume fraction of pearlite block having an aspect ratio of 2.0 or more is 70% or more with respect to all pearlite, the hydrogen embrittlement resistance improves significantly. Pearlite block having a small aspect ratio, namely one that is not sufficiently elongated does not contribute to the hydrogen embrittlement resistance very much, so it is preferable to suppress a ratio of the pearlite block having a small aspect ratio. Here, the aspect ratio of pearlite block is a ratio indicated by the major axis dimension/minor axis dimension of the pearlite block.

Further, in a case when a volume fraction of pearlite having an angle between a lamellar direction and an axial direction on a cross section parallel to the axial direction of 40° or less in the surface portion is 60% or less with respect to all pearlite, the hydrogen embrittlement resistance improves significantly.

Further, though the range of a C content will be described later, when the C content is represented by (C %), in a case of (C %) being not less than 0.35% nor more than 0.65%, the volume fraction of pearlite is 64×(C %)+52% or more, and in a case of (C %) being greater than 0.65% and 0.85% or less, the volume fraction of pearlite is not less than 94% nor more than 100%, and a structure of the other portion is composed of one or two of proeutectoid ferrite or bainite, the hydrogen embrittlement resistance improves significantly. Pealite has an effect of improving the hydrogen embrittlement resistance. Then, in a case when the volume fraction of pearlite is less than 64×(C %)+52%, the sufficient hydrogen embrittlement resistance cannot be obtained. Further, structures such as ferrite and bainite other than pearlite may be a starting point of fracture and thus a working crack is likely to occur in cold forging. Incidentally, in a case when structures other than pearlite exist, the structures may be proeutectoid ferrite and/or bainite. When martensite is contained as one of the structures other than pearlite, a crack is likely to occur in cold forging and the hydrogen embrittlement resistance deteriorates.

As above, the structure of the machine part is specified, and thereby it is possible to improve the hydrogen embrittlement resistance significantly. Then, in a case when the machine part is a bolt, it is possible to improve delayed fracture resistance significantly. Further, such a machine part is suitable for automobile parts and various industrial machine parts, and further may be used as a machine part for building.

Further, for obtaining the machine part such as a bolt, for example, a wire rod of special steel is made from a billet having a special steel composition, a steel wire of special steel is made from the wire rod of special steel, and forming work of the steel wire of special steel is performed. Then, in order to obtain the machine part excellent in hydrogen embrittlement resistance as described above, for example, it is preferable to make the structure of the steel wire of special steel to be the structure as described above and to perform forming work such as cold forging without performing a heat treatment such as spheroidizing. As compared with a method in which softening the steel wire of special steel is performed by a heat treatment such as spheroidizing to perform working, there is sometimes a case that the above method has difficulty in performing cold working slightly, but is more advantageous in terms of a reduction in cost due to the omission of a heat treatment, securing of the excellent hydrogen embrittlement resistance, and the like.

Next, there will be explained the components contained in the machine part and a billet used for manufacturing the machine part. The billet contains C: 0.35% to 0.85%, Si: 0.05% to 2.0%, Mn: 0.20% to 1.0%, and Al: 0.005% to 0.05%, and a P content is 0.030% or less, a S content is 0.030% or less, and a balance is composed of Fe and inevitable impurities. Then, the composition of each of the wire rod, the steel wire, and the machine part made from the billet is also the same.

C is contained for securing a predetermined tensile strength. When the C content is lower than 0.35%, it is difficult to secure the tensile strength of 1200 MPa or more. On the other hand, when the C content is higher than 0.85%, the strength corresponding to the C content cannot be obtained and cold forgeability deteriorates. Thus, the C content is 0.35% to 0.85%. Incidentally, for obtaining higher tensile strength, the C content is preferably 0.40% or higher, and is more preferably higher than 0.6%. Further, for obtaining better cold forgeability, the C content is preferably 0.60% or lower.

Si functions as a deoxidizing element, and has an effect of increasing the tensile strength by solid solution strengthening. When the Si content is lower than 0.05%, these effects are insufficient. On the other hand, when the Si content is higher than 2.0%, these effects are saturated and ductility during hot rolling deteriorates, and thus a flaw is likely to occur. Thus, the Si content is 0.05% to 2.0%. Incidentally, for obtaining higher tensile strength, the Si content is preferably 0.20% or higher. Further, for obtaining better workability by decreasing a rolling load during the hot rolling, the Si content is preferably 0.50% or lower.

Mn has an effect of increasing the tensile strength of the steel after pearlite transformation. When the Mn content is lower than 0.20%, this effect is insufficient. On the other hand, when the Mn content is higher than 1.0%, this effect is saturated. Thus, the Mn content is 0.20% to 1.0%.

Al functions as a deoxidizing element. Moreover, Al has an effect of improving cold workability by forming AlN to function as a pinning particle to make crystal grains refined. Further, Al has an effect of suppressing dynamic strain aging by decreasing solid solution N, and also has an effect of improving the hydrogen embrittlement resistance. When the Al content is lower than 0.005%, these effects are insufficient. On the other hand, when the Al content is higher than 0.05%, these effects are saturated and a flaw is likely to occur during hot rolling. Thus, the Al content is 0.005% to 0.05%.

P and S are segregated at grain boundaries so as to deteriorate the hydrogen embrittlement resistance. Then, in a case when the content of each of them is higher than 0.030%, the deterioration of the hydrogen embrittlement resistance is noticeable. Thus, the P content and the S content are each 0.030% or lower, and are each preferably 0.015% or lower.

Moreover, N may sometimes deteriorate the cold workability by dynamic strain aging and deteriorate also the hydrogen embrittlement resistance. Therefore, a N content is preferably small, is particularly preferably 0.005% or lower, and is more preferably 0.004% or lower.

Incidentally, the billet, the wire rod, the steel wire, and the machine part may also contain one or two of Cr: 0.02% to 1.0% or Ni: 0.02% to 0.50%. Moreover, the billet, the wire rod, the steel wire, and the machine part may also contain one or two or more of Ti: 0.002% to 0.050%, V: 0.01% to 0.20%, or Nb: 0.005% to 0.100%. Moreover, the billet, the wire rod, the steel wire, and the machine part may also contain B: 0.0001% to 0.0060%.

Cr has an effect of increasing the tensile strength of the steel after pearlite transformation. When the Cr content is lower than 0.02%, this effect is insufficient. On the other hand, when the Cr content is higher than 1.0%, martensite is likely to be formed, the cold workability deteriorates, and the material cost is increased. Thus, the Cr content is preferably 0.02% to 1.0%. For securely obtaining the effect, the Cr content is more preferably 0.10% or higher. Moreover, for suppressing the formation of martensite, the Cr content is more preferably 0.50% or lower.

Ni has an effect of increasing a toughness of a steel. When the Ni content is less than 0.02%, this effect is insufficient. When the Ni content is higher than 0.50%, martensite is likely to be formed, the cold workability deteriorates, and the material cost is increased. Thus, the Ni content is preferably 0.02% to 0.50%. Incidentally, for securely obtaining this effect, the Ni content is more preferably 0.05% or higher. Moreover, for suppressing the formation of martensite, the Ni content is more preferably 0.20%.

Ti functions as a deoxidizing element, and has an effect of increasing the tensile strength, the yield strength, and the proof stress by causing TiC to precipitate and has an effect of improving the cold workability by decreasing solid solution N. When the Ti content is lower than 0.002%, these effects are insufficient. On the other hand, when the Ti content is higher than 0.050%, these effects are saturated and the hydrogen embrittlement resistance deteriorates. Thus, the Ti content is preferably 0.002% to 0.050%.

V has an effect of increasing the tensile strength, the yield strength, and the proof stress by causing VC being carbide to precipitate and has an effect of improving the hydrogen embrittlement resistance. When the V content is lower than 0.01%, these effects are insufficient. On the other hand, when the V content is higher than 0.20%, the material cost is increased drastically. Thus, the V content is preferably 0.01% to 0.20%.

Nb has an effect of increasing the tensile strength, the yield strength, and the proof stress by causing NbC being carbide to precipitate. When the Nb content is lower than 0.005%, this effect is insufficient. When the Nb content is higher than 0.100%, this effect is saturated. Thus, the Nb content is preferably 0.005% to 0.10%.

B has an effect of improving the cold workability and the hydrogen embrittlement resistance by suppressing formation of grain boundary ferrite and grain boundary bainite, and has an effect of increasing the tensile strength after the pearlite transformation. When the B content is lower than 0.0001%, these effects are insufficient. On the other hand, when the B content is higher than 0.0060%, this effect is saturated. Thus, the B content is preferably 0.0001% to 0.0060%.

Moreover, the billet, the wire rod, the steel wire, and the machine part may also contain one or two or more of Ca: 0.001 to 0.010%, Mg: 0.001 to 0.010%, and Zr: 0.001 to 0.010%. These elements each function as a deoxidizing element and have an effect of improving the hydrogen embrittlement resistance by forming sulfides such as CaS and MgS to fix solid solution S.

Further, the billet, the wire rod, the steel wire, and the machine part each may contain O inevitably, and O may exist as oxides such as Al and Ti. Then, as an O content is higher, coarse oxides are likely to be formed and a fatigue fracture is likely to occur. Therefore, the O content is preferably 0.01% or less.

Next, there will be explained a manufacturing method of a wire rod of special steel suitable for manufacturing the machine part and the steel wire of special steel as described above.

In the manufacturing method, hot rolling of the billet containing the above-described components is performed so as to obtain a steel material, next the steel material is immersed in a first molten salt bath to be held isothermally, and next the steel material is immersed in a second molten salt bath to be held isothermally. In the hot rolling, the temperature of finish rolling is not lower than 800° C. nor higher than 950° C., and a grain size number of austenite grains of the steel material is made 8 or more. Moreover, the temperature of the first molten salt bath is not lower than 400° C. nor higher than 600° C., and the immersion into the first molten salt bath is performed when the temperature of the steel material is not lower than 750° C. nor higher than 950° C., and a period of time for the isothermal holding is not shorter than 5 seconds nor longer than 150 seconds. Further, the temperature of the second molten salt bath is not lower than 500° C. nor higher than 600° C., and a period of time for the isothermal holding is not shorter than 5 seconds nor longer than 150 seconds.

The temperature of the finish rolling affects the grain size of austenite grains before the pearlite transformation to occur thereafter, and when the temperature of the finish rolling is higher than 950° C., fine grains with a grain size number of 8 or more are not likely to be obtained. On the other hand, when the temperature of the finish rolling is lower than 800° C., a load during rolling is extremely high and industrial mass production is difficult. Thus, the temperature of the finish rolling is 800° C. to 950° C. When mass productivity is considered, the temperature of the finish rolling is preferably 850° C. or higher.

Moreover, when the grain size number of austenite grains before the pearlite transformation are less than 8, due to the effect of coarse grains, a crack is likely to occur during wire drawing and cold forging thereafter. Thus, the grain size number of austenite grains is 8 or more, and is preferably 10 or more.

In the present invention, by the isothermal holding in the first molten salt bath, the temperature of the steel material is rapidly lowered to the temperature close to a starting temperature of the pearlite transformation, and in the subsequent isothermal holding in the second molten salt bath, the pearlite transformation is caused to occur in the steel material.

When the temperature of the steel material when being immersed into the first molten salt bath is lower than 750° C., ferrite is more likely to be formed during the isothermal holding in the first or second molten salt bath. On the other hand, when the temperature is higher than 950° C., time is taken for lowering the temperature. That is, time is taken for lowering the temperature of the steel material close to a starting temperature of the pearlite transformation. Therefore, there is sometimes a case that the pearlite transformation is not completed during the isothermal holding in the second molten salt bath and the structure such as bainite and/or martensite is formed. Thus, the temperature of the steel material when the steel material is immersed into the first molten salt bath is 750° C. to 950° C.

Moreover, when the temperature of the first molten salt bath is lower than 400° C., bainite is formed. On the other hand, when the temperature of the first molten salt bath is higher than 600° C., reaching to the starting temperature of the pearlite transformation is delayed. Thus, the temperature of the first molten salt bath is 400° C. to 600° C. Further, in a case when the temperature of the second molten salt bath is 500° C. to 600° C., the pearlite transformation is completed for an extremely short period of time. Thus, the temperature of the second molten salt bath is 500° C. to 600° C.

Further, when the period of time for the isothermal holding in the first molten salt bath and the second molten salt bath is shorter than 5 seconds, the temperature of the steel material cannot be sometimes controlled sufficiently. On the other hand, when the period of time for the isothermal holding is longer than 150 seconds, a reduction in productivity sometimes is noticeable. Thus, the period of time for the isothermal holding in the molten salt baths is 5 seconds to 150 seconds.

Incidentally, the same effect may be obtained even though facilities such as a lead bath and a fluidized bed are used in place of the molten salt bath, but when a load on the environment and the manufacturing cost are considered, the method of using molten salt is extremely excellent.

Then, the wire rod of special steel obtained by such processes has the above-described composition, and in the case when (C %) is not less than 0.35% nor more than 0.65%, the volume fraction of pearlite is 64×(C %)+52% or more, and in the case when (C %) is greater than 0.65% and 0.85% or less, the volume fraction of pearlite is not less than 94% nor more than 100%, and the structure of the other portion is composed of one or two of proeutectoid ferrite and bainite.

Also as for the wire rod of special steel, in the case when the volume fraction of pearlite is less than 64×(C %)+52%, the sufficient hydrogen embrittlement resistance cannot be obtained. Further, a structure other than pearlite such as ferrite and bainite functions as a starting point of fracture and a working crack is likely to occur in the cold forging. Thus, it is important that in the case of (C %) being not less than 0.35% nor more than 0.65%, the volume fraction of pearlite is 64×(C %)+52% or more, and in the case of (C %) being greater than 0.65% and 0.85% or less, the volume fraction of pearlite is not less than 94% nor more than 100% also in the wire rod of special steel. Further, when martensite is contained in the wire rod of special steel as the structure other than pearlite, a crack is likely to occur not only in the cold forging but also in the wire drawing.

Incidentally, the volume fraction of pearlite may be measured by an optical microscope observation or electron microscope observation of the wire rod of special steel, and may be obtained from an area ratio in an arbitrary visual field. Further, the state of austenite grains may be fixed in a manner that a sample of the steel material immediately after the rolling is taken to be quenched, and the grain size may be measured by the method of JIS G0551 using the sample after the quenching.

As above, in the manufacturing method of the wire rod of special steel, the temperature control is performed with the two molten salt baths immediately after the hot rolling, utilizing remaining heat of hot rolling. Then, according to the method, even though addition of expensive alloy elements is suppressed, the wire rod of special steel having the high volume fraction of pearlite can be obtained. That is, the high property can be obtained inexpensively.

Then, in a case when a steel wire of special steel having the structure as described above is made from the wire rod of special steel manufactured in the manner, wire drawing is performed under predetermined conditions.

A total reduction of area in the wire drawing is not less than 25% nor more than 80%. In a case when the total reduction of area in the wire drawing is lower than 25%, the elongation of pearlite block is insufficient to thus make it impossible to obtain the sufficient hydrogen embrittlement resistance. On the other hand, when the total reduction of area is higher than 80%, a working crack is likely to occur in the cold forging. Thus, the total reduction of area in the wire drawing is 25% to 80%. Incidentally, the total reduction of area is preferably 30% or more for promoting the elongation of pearlite block. Further, for further suppressing a working crack, the total reduction of area is preferably 65% or less.

Further, the number of times of the wire drawing is not limited in particular, and one time may be accepted, or a plurality of times may also be accepted. In the case when the wire drawing is performed a plurality of times, the reduction of area in the final wire drawing (final pass) is preferably not less than 1% nor more than 15%. This is because it is possible to further elongate the pearlite block in the surface portion and to further align the lamellar direction and the axial direction. When the reduction of area in the final pass is lower than 1%, it is likely to be difficult to uniformly apply strain to a circumferential direction. On the other hand, when the reduction of area in the final pass is higher than 15%, the above-described effect cannot be obtained easily. Thus, the reduction of area in the final wire drawing in the case when the wire drawing is performed a plurality of times is preferably 1% to 15%.

Further, the wire drawing is performed at room temperature. Here, the room temperature may correspond to −20° C. to 50° C., but there is sometimes a case that during the wire drawing, the steel wire is increased to about 100° C. or so in temperature due to heat generation by working.

By the wire drawing performed under such conditions, the steel wire of special steel having the desired strength and excellent hydrogen embrittlement resistance can be obtained. That is, there can be obtained a steel wire in which the volume fraction of pearlite block having an aspect ratio of 2.0 or more is 70% or more with respect to all pearlite in a region up to a depth of 1.0 mm from the surface, and the volume fraction of pearlite having an angle between the axial direction and the lamellar direction in the region to a depth of 1.0 mm from the surface on the cross section parallel to the axial direction of 40° or less is 60% or more with respect to all pearlite.

As described above, in the case when the volume fraction of pearlite block having an aspect ratio of 2.0 or more is 70% or more with respect to all pearlite in the region to a depth of 1.0 mm from the surface, the excellent hydrogen embrittlement resistance can be obtained. However, when this volume fraction is higher than 95%, the cold forgeability deteriorates. That is, the cold forging is likely to be difficult to be performed. For this reason, in the region to a depth of 1.0 mm from the surface, the volume fraction of pearlite block as above is 70% to 95% with respect to all pearlite. Incidentally, for obtaining the more excellent hydrogen embrittlement resistance, this volume fraction is preferably 80% or more. The reason why the aspect ratio of pearlite block used for the evaluation of the volume fraction is set to 2.0 or more is because the pearlite block that is not elongated sufficiently, of which the aspect ratio is less than 2.0, does not contribute to the hydrogen embrittlement resistance very much.

Further, as described above, in the case when the volume fraction of pearlite having an angle between the lamellar direction and the axial direction in the region to a depth of 1.0 mm from the surface on the cross section parallel to the axial direction of 40° or less is 60% or more with respect to all pearlite, the excellent hydrogen embrittlement resistance can be obtained. Pearlite contributing to the improvement of hydrogen embrittlement resistance is one of which the angle is 40° or less mainly. Thus, the angle of pearlite used for the evaluation of the volume fraction is 40° or less. Further, in the case when the volume fraction of pearlite having the angle of 40° or less is less than 60%, the effect of improving the hydrogen embrittlement resistance is not sufficient. Thus, on the cross section parallel to the axial direction, such a volume fraction of pearlite is 60% or more with respect to all pearlite. Incidentally, for obtaining the more excellent hydrogen embrittlement resistance, the volume fraction is preferably 70% or more.

Incidentally, the pearlite block described here is a unit of pearlite composed of ferrite and cementite having a misorientation within 15 degrees, and the misorientation may be obtained from a crystal orientation map of ferrite measured with an electron back scattered diffraction (EBSD: electron back scattered diffraction) apparatus. Further, the aspect ratio of pearlite block is the ratio of the major axis to the minor axis of the pearlite block, and as for the steel wire of special steel after the wire drawing, the aspect ratio is substantially equal to a ratio of a dimension in the axial direction to a dimension in a direction perpendicular to the axial direction (a radial direction). Further, the lamellar direction may be measured through an electron microscope observation on the cross section parallel to the axial direction.

Then, in a case when the machine part is made from the steel wire of special steel manufactured in this manner, for maintaining the above-described microstructure, for example, the forming work such as the cold forging is performed at room temperature of, for example, −20° C. to 50° C. without performing a heat treatment such as spheroidizing. Incidentally, in the cold forging, there is sometimes a case that the steel wire of special steel is increased to 300° C. or so in temperature due to heat generation by the working.

Incidentally, the tensile strength of the machine part to be targeted by the present invention is not less than 1200 MPa nor more than 1500 MPa. When the tensile strength is lower than 1200 MPa, a hydrogen embrittlement is not likely to occur, and thus the present invention is not required to be applied. On the other hand, when the tensile strength is higher than 1500 MPa, the forming work by the cold forging is difficult to be performed, and thus the manufacturing cost is increased.

Incidentally, the machine part manufactured in this manner has the high strength and excellent hydrogen embrittlement resistance, but is preferably held for not shorter than 10 minutes nor longer than 60 minutes at 200° C. to 600° C. to thereafter be cooled, for example, for improving other mechanical properties. By performing such a process, it is possible to improve the yield strength, the yield ratio, the ductility, and so on.

As above, in a series of processes, the material having the chemical composition adjusted so as to turn the structure into pearlite is used, and by a method of immersing the material in the molten salt baths with utilizing remaining heat of hot rolling, the material is made into the steel wire of special steel having the structure of almost complete pearlite. Then, this steel wire of special steel is subjected to the wire drawing at room temperature under the specific conditions to perform adjustment of pearlite having the high strength and hydrogen embrittlement resistance, and is formed into the machine part. Thereafter, a heat treatment at a relatively low temperature for recovering the ductility may be performed according to need. As a result, it is possible to significantly improve the hydrogen embrittlement resistance of the machine part having a tensile strength of not less than 1200 MPa nor more than 1500 MPa inexpensively. Further, as the wire drawing, heavy wire drawing such as a conventional technique is not required to be performed.

EXAMPLE

Next, experiments conducted by the present inventors will be explained. The conditions and so on in these experiments are examples employed for confirming the applicability and effects of the present invention, and the present invention is not limited to these examples.

First, billets each being a steel type containing components presented in Table 1 were made. Then, under the conditions presented in Table 2, the billets were each subjected to the hot rolling including the finish rolling, the isothermal holding in the first molten salt bath, and the isothermal holding in the second molten salt bath, and wire rods each having a wire diameter (7.0 mm to 15.0 mm) presented in Table 2 were obtained. Incidentally, the first molten salt bath and the second molten salt bath were disposed in a rolling line, and what is called an in-line process was performed. Further, after the hot rolling, sampling was performed and the grain size number of austenite grains before the pearlite transformation was measured. Results of the measurement are also presented in Table 2.

TABLE 1

| STEEL TYPE | c | Si | Mn | P | S | Al | N | Cr | Ni | Mo | V | Nb | Ti | B | OTHER | REMARKS |
|---|---|---|---|---|---|---|---|---|---|---|---|---|---|---|---|---|
| A | 0.36 | 0.24 | 0.72 | 0.008 | 0.023 | 0.034 | 0.0024 | | | | | 0.010 | | | | |
| B | 0.38 | 0.23 | 0.65 | 0.015 | 0.006 | 0.038 | 0.0039 | | | | | | | | | |
| C | 0.42 | 0.20 | 0.51 | 0.018 | 0.003 | 0.008 | 0.0028 | 0.48 | | | | 0.030 | | | Ca: 0.0024 | |
| D | 0.44 | 0.32 | 0.74 | 0.009 | 0.007 | 0.015 | 0.0029 | 0.14 | | | | | 0.015 | 0.0011 | | |
| E | 0.44 | 0.08 | 0.46 | 0.013 | 0.011 | 0.027 | 0.0029 | | 0.20 | | 0.15 | | | | | |
| F | 0.46 | 0.32 | 0.72 | 0.015 | 0.016 | 0.027 | 0.0027 | | | | | 0.050 | | | | |
| G | 0.46 | 0.09 | 0.45 | 0.012 | 0.009 | 0.025 | 0.0029 | | | | 0.18 | | | | | |
| H | 0.48 | 0.21 | 0.72 | 0.011 | 0.014 | 0.011 | 0.0026 | | | | | | | | Mg: 0.0015 | |
| I | 0.48 | 1.24 | 0.41 | 0.016 | 0.013 | 0.035 | 0.0028 | 0.21 | 0.30 | | | | 0.020 | 0.0009 | | |
| J | 0.52 | 0.21 | 0.73 | 0.014 | 0.012 | 0.028 | 0.0024 | | | | 0.04 | | | | | |
| K | 0.59 | 0.24 | 0.77 | 0.011 | 0.004 | 0.037 | 0.0035 | | | | | | | | | |
| L | 0.67 | 0.22 | 0.71 | 0.009 | 0.005 | 0.025 | 0.0034 | | | | | | | | | |
| M | 0.69 | 0.21 | 0.65 | 0.009 | 0.004 | 0.019 | 0.0036 | | | | | | | | | |
| N | 0.47 | 0.17 | 0.80 | 0.017 | 0.032 | 0.032 | 0.0061 | 1.20 | | 0.30 | | | | | | COPARATIVE EXAMPLE |
| O | 0.29 | 0.52 | 1.10 | 0.012 | 0.016 | 0.030 | 0.0053 | | | | | | | | | COPARATIVE EXAMPLE |
| P | 0.75 | 0.22 | 0.72 | 0.011 | 0.009 | 0.027 | 0.0045 | | | | | | | | | |
| Q | 0.79 | 0.24 | 0.77 | 0.008 | 0.005 | 0.026 | 0.0046 | | | | | | | | | |

TABLE 2

| STANDARD | STEEL TYPE | DIAM-ETER (mm) | TEMPER-ATURE OF FINISH ROLLING (° C.) | TEMPER-ATURE OF FIRST MOLTEN SALT BATH (° C.) | HOLDING TIME IN FIRST MOLTEN SALT BATH (sec) | TEMPER-ATURE OF SECOND MOLTEN SALT BATH (° C.) | HOLDING TIME IN SECOND MOLTEN SALT BATH (sec) | GRAIN SIZE UMBER OF AUSTENITE BEFORE TRANSFORM-ATION |
|---|---|---|---|---|---|---|---|---|
| 1 | A | 15.0 | 880 | 540 | 40 | 540 | 70 | 8.9 |
| 2 | B | 7.0 | 930 | 550 | 30 | 550 | 53 | 8.8 |
| 3 | C | 15.0 | 880 | 530 | 43 | 540 | 78 | 9.2 |
| 4 | D | 14.5 | 860 | 560 | 32 | 560 | 55 | 10.9 |
| 5 | D | 14.5 | 860 | — | — | — | — | 7.3 |
| 6 | E | 14.0 | 910 | 530 | 36 | 550 | 65 | 10.4 |
| 7 | E | 14.0 | 910 | 530 | 36 | 550 | 65 | 10.4 |
| 8 | E | 14.0 | 910 | 530 | 36 | 550 | 65 | 10.4 |
| 9 | E | 14.0 | 910 | 530 | 36 | 550 | 65 | 10.4 |
| 10 | F | 14.5 | 910 | 540 | 40 | 550 | 70 | 10.3 |
| 11 | G | 14.5 | 910 | 570 | 47 | 580 | 80 | 10.1 |
| 12 | H | 14.5 | 890 | 530 | 54 | 550 | 95 | 11.2 |
| 13 | H | 14.5 | 890 | — | — | — | — | 7.1 |
| 14 | H | 12.5 | 900 | 480 | 4 | 550 | 15 | 11.8 |
| 15 | I | 12.5 | 900 | 500 | 36 | 560 | 65 | 10.6 |
| 16 | J | 7.0 | 930 | 530 | 22 | 560 | 40 | 10.2 |
| 17 | J | 7.0 | 930 | 350 | 22 | 560 | 40 | 10.9 |
| 18 | K | 13.5 | 910 | 550 | 32 | 550 | 40 | 9.9 |
| 19 | K | 8.0 | 930 | 550 | 22 | 550 | 40 | 10..6 |
| 20 | L | 7.0 | 930 | 540 | 36 | 550 | 65 | 11.6 |
| 21 | M | 14.5 | 890 | 530 | 51 | 550 | 90 | 9.2 |
| 22 | M | 7.0 | 930 | 530 | 30 | 550 | 50 | 9.7 |
| 23 | N | 12.5 | 910 | — | — | — | — | 7.5 |
| 24 | O | 13.0 | 910 | 540 | 35 | 550 | 55 | 9.9 |
| 25 | P | 13.0 | 910 | 540 | 35 | 550 | 55 | 10.4 |
| 26 | Q | 13.0 | 910 | 540 | 35 | 550 | 55 | 9.7 |

| STANDARD | TENSILE STRENGTH OF WIRE ROD (MPa) | TOTAL REDUCTION OF AREA (%) | REDUCTION OF AREA AT FINAL DRAWING (%) | TEMPER-ATURE OF HEAT TREATMENT (° C.) | HOLDING TIME OF HEAT TREATMENT (min) | PRESENCE/ ABSENCE OF DRAWING CRACK | REMARKS |
|---|---|---|---|---|---|---|---|
| 1 | 712 | 68.0 | 12.7 | 400 | 30 | NO CRACK | EXAMPLE |
| 2 | 753 | 54.2 | 11.5 | 380 | 30 | NO CRACK | EXAMPLE |
| 3 | 762 | 66.9 | 9.8 | 450 | 30 | NO CRACK | EXAMPLE |
| 4 | 788 | 58.0 | 9.8 | — | — | NO CRACK | EXAMPLE |
| 5 | 688 | 58.0 | 19.6 | — | — | NO CRACK | COMPARATIVE EXAMPLE |
| 6 | 787 | 18.2 | 18.2 | 500 | 30 | NO CRACK | COMPARATIVE EXAMPLE |
| 7 | 787 | 45.2 | 22.2 | 500 | 30 | NO CRACK | EXAMPLE |
| 8 | 787 | 45.2 | 12.1 | 500 | 30 | NO CRACK | EXAMPLE |
| 9 | 787 | 45.2 | 12.1 | — | — | NO CRACK | EXAMPLE |
| 10 | 824 | 58.4 | 20.6 | 430 | 30 | NO CRACK | EXAMPLE |

TABLE 2-continued

| | | | | | | | |
|---|---|---|---|---|---|---|---|
| 11 | 761 | 52.5 | 19.2 | 540 | 30 | NO CRACK | EXAMPLE |
| 12 | 843 | 58.4 | 20.6 | 400 | 30 | NO CRACK | EXAMPLE |
| 13 | 691 | 58.4 | 20.6 | 400 | 30 | NO CRACK | COMPARATIVE EXAMPLE |
| 14 | 880 | 50.9 | — | — | — | DRAWING CRACK OCCURRED | COMPARATIVE EXAMPLE |
| 15 | 843 | 44.2 | 20.4 | 380 | 30 | NO CRACK | EXAMPLE |
| 16 | 817 | 50.8 | 9.5 | 480 | 30 | NO CRACK | EXAMPLE |
| 17 | 1062 | 38.0 | — | — | — | DRAWING CRACK OCCURRED | COMPARATIVE EXAMPLE |
| 18 | 967 | 43.0 | 10.9 | — | — | NO CRACK | EXAMPLE |
| 19 | 983 | 53.5 | 11.8 | 400 | 30 | NO CRACK | EXAMPLE |
| 20 | 1076 | 28.6 | 7.4 | — | — | NO CRACK | EXAMPLE |
| 21 | 1077 | 14.5 | 14.5 | 350 | 30 | NO CRACK | COMPARATIVE EXAMPLE |
| 22 | 1112 | 82.0 | 21.3 | 350 | 30 | NO CRACK | COMPARATIVE EXAMPLE |
| 23 | 870 | — | — | — | — | NO CRACK | COMPARATIVE EXAMPLE |
| 24 | 683 | 29.8 | 29.8 | 350 | 30 | NO CRACK | COMPARATIVE EXAMPLE |
| 25 | 1145 | 24.0 | 24.0 | 350 | 30 | NO CRACK | COMPARATIVE EXAMPLE |
| 26 | 1214 | 10.5 | 10.5 | 400 | 30 | NO CRACK | COMPARATIVE EXAMPLE |

After the wire rods were made, the wire drawing with a reduction of area presented in Table 2 was performed and steel wires were obtained. Further, in standards 1 to 3, 6 to 8, 10 to 13, 15 to 16, 19, 21 to 22, and 24 to 26, a heat treatment imitated from a heat treatment after a cold forging was performed. Results of the heat treatment are also presented in Table 2.

Further, as for each of the wire rods, the type of metal structure and the volume fraction of pearlite were measured. Results of the measurement are presented in Table 3. Incidentally, in the section of "METAL STRUCTURE" in Table 3, "P" represents pearlite, "B" represents bainite, "F" represents ferrite, and "M" represents martensite. Further, in Table 3, "LOWER LIMIT OF VOLUME FRACTION OF PEARLITE" indicates the value of 64×(Co)+52% in the case when (Co) is 0.65% or less, and the value is 94% in the case when (Co) is higher than 0.65%.

TABLE 3

| STAN-DARD | STEEL TYPE | METAL STRUCTURE | LOWER LIMIT OF VOLUME FRACTION OF PEARLITE (%) | VOLUME FRACTION OF PEARLITE (%) | VOLUME FRACTION OF PEARLITE BLOCK HAVING ASPECT RATIO OF 2.0 OR MORE (%) | VOLUME FRACTION OF PEARLITE HAVING ANGLE BETWEEN LAMELLAR DIRECTION AND AXIAL DIRECTION OF 40° OR LESS (%) | REMARKS |
|---|---|---|---|---|---|---|---|
| 1 | A | P, B, F | 75.0 | 87 | 71 | 71 | EXAMPLE |
| 2 | B | P, B, F | 76.3 | 90 | 77 | 73 | EXAMPLE |
| 3 | C | P, B, F | 78.9 | 88 | 72 | 72 | EXAMPLE |
| 4 | D | P, B, F | 80.2 | 94 | 82 | 73 | EXAMPLE |
| 5 | D | P, F | 80.2 | 68 | 76 | 41 | COMPARATIVE EXAMPLE |
| 6 | E | P, B, F | 80.2 | 92 | 62 | 48 | COMPARATIVE EXAMPLE |
| 7 | E | P, B, F | 80.2 | 92 | 81 | 84 | EXAMPLE |
| 8 | E | P, B, F | 80.2 | 92 | 83 | 66 | EXAMPLE |
| 8 | E | P, B, F | 80.2 | 90 | 79 | 64 | EXAMPLE |
| 10 | F | P, B, F | 81.4 | 93 | 88 | 73 | EXAMPLE |
| 11 | G | P, B, F | 81.4 | 92 | 87 | 75 | EXAMPLE |
| 12 | H | P, B, F | 82.7 | 93 | 86 | 74 | EXAMPLE |
| 13 | H | P, F | 82.7 | 76 | 68 | 53 | COMPARATIVE EXAMPLE |
| 14 | H | P, B, M, F | 82.7 | 67 | 74 | 63 | COMPARATIVE EXAMPLE |
| 15 | I | P, B, F | 82.7 | 91 | 80 | 69 | EXAMPLE |
| 16 | J | P, B, F | 85.3 | 92 | 88 | 82 | EXAMPLE |
| 17 | J | P, B, M | 85.3 | 42 | 54 | 47 | COMPARATIVE EXAMPLE |
| 18 | K | P, B, F | 89.8 | 95 | 88 | 72 | EXAMPLE |
| 19 | K | P, B, F | 89.8 | 95 | 91 | 88 | EXAMPLE |
| 20 | L | P, B | 94.0 | 98 | 73 | 82 | EXAMPLE |
| 21 | M | P | 94.0 | 100 | 41 | 44 | COMPARATIVE EXAMPLE |

TABLE 3-continued

| STAN-DARD | STEEL TYPE | METAL STRUCTURE | LOWER LIMIT OF VOLUME FRACTION OF PEARLITE (%) | VOLUME FRACTION OF PEARLITE (%) | VOLUME FRACTION OF PEARLITE BLOCK HAVING ASPECT RATIO OF 2.0 OR MORE (%) | VOLUME FRACTION OF PEARLITE HAVING ANGLE BETWEEN LAMELLAR DIRECTION AND AXIAL DIRECTION OF 40° OR LESS (%) | REMARKS |
|---|---|---|---|---|---|---|---|
| 22 | M | P | 94.0 | 100 | 97 | 74 | COMPARATIVE EXAMPLE |
| 23 | N | M | 82.1 | — | — | — | COMPARATIVE EXAMPLE |
| 24 | O | P, F, B | 70.6 | 67 | 43 | 44 | COMPARATIVE EXAMPLE |
| 25 | P | P | 94.0 | 100 | 77 | 57 | COMPARATIVE EXAMPLE |
| 26 | Q | P | 94.0 | 100 | 52 | 43 | COMPARATIVE EXAMPLE |

In the measurement of the volume fraction of pearlite, an area ratio of pearlite was obtained with a scanning electron microscope (SEM), and due to the area ratio on a microscopic observation surface being equal to the volume fraction of the structure, each of the area ratios obtained by image analysis was set to be the volume fraction of each of the structures. Further, in the measurement of the area ratio, on a cross section parallel to the axial direction of each of the steel wires, a region having a size of 125 μm×95 μm in a surface portion was photographed at a magnification of 1000 times and the area ratio of pearlite was obtained by image analysis.

As for each of the steel wires, the volume fraction of pearlite block having an aspect ratio of 2.0 or more was measured. Further, on each of the cross sections parallel to the axial direction, the volume fraction of pearlite having an angle between the lamellar direction and the axial direction in the surface portion of 40° or less was also measured. Results of the measurement are also presented in Table 3. Incidentally, the type of structure of each of the steel wires is the same as that of each of the wire rods.

For identification of the pearlite block, an EBSD apparatus was used. That is, on each of the cross sections parallel to the axial direction, a crystal orientation map of ferrite in a region having a size of 275 μm×165 μm in the surface portion was obtained with an EBSD apparatus, and from the crystal orientation map, a boundary having a misorientation of 15 degrees or more was set to a boundary of the pearlite block. Then, the aspect ratio of the pearlite block having a circle-equivalent diameter of 1.0 μm or more among the pearlite blocks each surrounded by the boundary was obtained.

Further, on each of the cross sections parallel to the axial direction, in the measurement of the volume fraction of pearlite having an angle between the lamellar direction and the axial direction in the surface portion of 40° or less, based on a SEM photograph at a magnification of 5000 times obtained by photographing a region in the surface portion, the region was subjected to image analysis. Concretely, as illustrated in FIG. 1, a region of which an angle between the lamellar direction and the axial direction (misorientation) was 40° or less was obtained from the SEM photograph and an area of the region was subjected to image analysis. Each of the white arrows in FIG. 1 indicates the lamellar direction.

After each of the steel wires was made, the properties (the tensile strength, the hydrogen embrittlement resistance, and the cold forgeability) of the steel wire after being subjected to the processes presented in Table 2 were evaluated. Results of the evaluation are presented in Table 4.

In the evaluation of the tensile strength, a 9A test piece of JIS 22201 was made from each of the steel wires, and a tensile test based on the test method of JIS 22241 was performed. Incidentally, the tensile strength of the machine part made from each of these steel wires is equal to that of the steel wire.

In the evaluation of the hydrogen embrittlement resistance, each of the steel wires was formed into a bolt, and diffusible hydrogen of 0.5 ppm was contained in each of samples by electrolytic hydrogen charge, and then Cd plating was performed so that hydrogen might not be released into the atmosphere from the sample during the test. Thereafter, a load of 90% of a maximum tensile load was loaded in the atmosphere and the existence or absence of fracture after 100 hours was confirmed. Then, one having had no fracture caused therein was evaluated to be "excellent" and one having had fracture caused therein was evaluated to be "poor."

In the evaluation of the cold forgeability, a sample having a diameter of 5.0 mm and a length of 7.5 mm was made from each of the steel wires by machining, and edge surfaces were held by molds each having a groove therein concentrically and a compression test was performed. Then, one having had no working crack caused therein when the steel wire was worked at a compression ratio of 50% was evaluated to be "excellent" and one having had a working crack caused therein was evaluated to be "poor."

TABLE 4

| STANDARD | STEEL TYPE | TENSILE STRENGTH (MPa) | HYDRGEN EMBRITTLEMENT RESISTANCE | COLD FORGEABILITY | REMARKS |
|---|---|---|---|---|---|
| 1 | A | 1207 | EXCELLENT | EXCELLENT | EXAMPLE |
| 2 | B | 1220 | EXCELLENT | EXCELLENT | EXAMPLE |

TABLE 4-continued

| STANDARD | STEEL TYPE | TENSILE STRENGTH (MPa) | HYDRGEN EMBRITTLEMENT RESISTANCE | COLD FORGEABILITY | REMARKS |
|---|---|---|---|---|---|
| 3 | C | 1243 | EXCELLENT | EXCELLENT | EXAMPLE |
| 4 | D | 1262 | EXCELLENT | EXCELLENT | EXAMPLE |
| 5 | D | 1083 | POOR | POOR | COMPARATIVE EXAMPLE |
| 6 | E | 1050 | POOR | POOR | COMPARATIVE EXAMPLE |
| 7 | E | 1245 | EXCELLENT | EXCELLENT | EXAMPLE |
| 8 | E | 1216 | EXCELLENT | EXCELLENT | EXAMPLE |
| 9 | E | 1256 | EXCELLENT | EXCELLENT | EXAMPLE |
| 10 | F | 1220 | EXCELLENT | EXCELLENT | EXAMPLE |
| 11 | G | 1286 | EXCELLENT | EXCELLENT | EXAMPLE |
| 12 | H | 1222 | EXCELLENT | EXCELLENT | EXAMPLE |
| 13 | H | 1178 | POOR | POOR | COMPARATIVE EXAMPLE |
| 14 | H | 1273 | — | — | COMPARATIVE EXAMPLE |
| 15 | I | 1235 | EXCELLENT | EXCELLENT | EXAMPLE |
| 16 | J | 1366 | EXCELLENT | EXCELLENT | EXAMPLE |
| 17 | J | 1420 | — | — | COMPARATIVE EXAMPLE |
| 18 | K | 1235 | EXCELLENT | EXCELLENT | EXAMPLE |
| 19 | K | 1405 | EXCELLENT | EXCELLENT | EXAMPLE |
| 20 | L | 1276 | EXCELLENT | EXCELLENT | EXAMPLE |
| 21 | M | 1232 | POOR | POOR | COMPARATIVE EXAMPLE |
| 22 | M | 1591 | EXCELLENT | POOR | COMPARATIVE EXAMPLE |
| 23 | N | 1521 | POOR | — | COMPARATIVE EXAMPLE |
| 24 | O | 1026 | POOR | EXCELLENT | COMPARATIVE EXAMPLE |
| 25 | P | 1280 | EXCELLENT | POOR | COMPARATIVE EXAMPLE |
| 26 | Q | 1332 | POOR | POOR | COMPARATIVE EXAMPLE |

In Table 2, the standards 5 and 13 correspond to a conventional manufacturing method in which cooling is performed on a Stelmor without performing an isothermal transformation process after coiling, and the volume fraction of pearlite of each of them falls outside the range of the present invention. In the standard 14, the holding time in the first molten salt bath is shorter than the lower limit of the present invention. In this case, martensite is mixed in the metal structure and the volume fraction of pearlite falls outside the range of the present invention. In the standard 17, the temperature of the first molten salt bath is lower than the lower limit of the present invention. In this case, martensite is mixed in the metal structure and the volume fraction of pearlite falls outside the range of the present invention. In the standards 6, 21, 25, and 26, the reduction of area in the wire drawing is less than the lower limit of the present invention. In this case, the volume fraction of pearlite block having an aspect ratio of 2.0 or more, or the volume fraction of pearlite having an angle between the lamellar direction and the axial direction of 40° or less falls outside the range of the present invention. In the standard 23, Cr and Mo are contained and the steel type of N having a composition falling outside the range of the present invention was used. Further, after coiling, the processes with the use of the first and second molten salt baths were not performed and cooling was performed on a Stelmor, and the wire rod was thus manufactured, and thereafter the wire rod was heated to 880° C. and was subjected to oil quenching and hardening, and next was subjected to tempering at 580° C. As a result, the obtained structure is tempered martensite to thus fall outside the range of the present invention.

As for the grain size number of austenite grains before the pearlite transformation presented in Table 2, in both the standards 4 and 12 each satisfying the condition of the present invention, the grain size number is 10 or more. In contrast to this, in the standards 5, 13, and 23 each having the manufacturing condition falling outside the range of the present invention, the grain size number is less than 8, and it is found from Table 4 that they deteriorate in the cold forgeability or hydrogen embrittlement resistance. In the standards 14 and 17 each containing martensite, wire breakage or a crack occurred during the wire drawing. That is, wire drawability was poor.

In all the standards 5, 13, 23, and 24 in which the volume fraction of pearlite falls outside the range of the present invention, the hydrogen embrittlement resistance is poor. Further, in all the standards 6, 13, 21, 23, 24, and 26, in which the volume fraction of pearlite block having an aspect ratio of 2.0 or more falls outside the range of the present invention, the hydrogen embrittlement resistance is poor. In the standards 5, 6, 13, 21, 23, 24, 25, and 26, in which the area ratio of pearlite having an angle between the lamellar direction and the axial direction of 40° or less falls outside the range of the present invention, the hydrogen embrittlement resistance and/or the cold forgeability are/is poor. Further, in the standard 22, in which the volume fraction of pearlite block having an aspect ratio of 2.0 or more is higher than the upper limit of the present invention, the cold forgeability is poor.

From the above, it is found that the machine part according to the present invention is excellent in hydrogen embrittlement resistance and cold forgeability.

Figure 2:
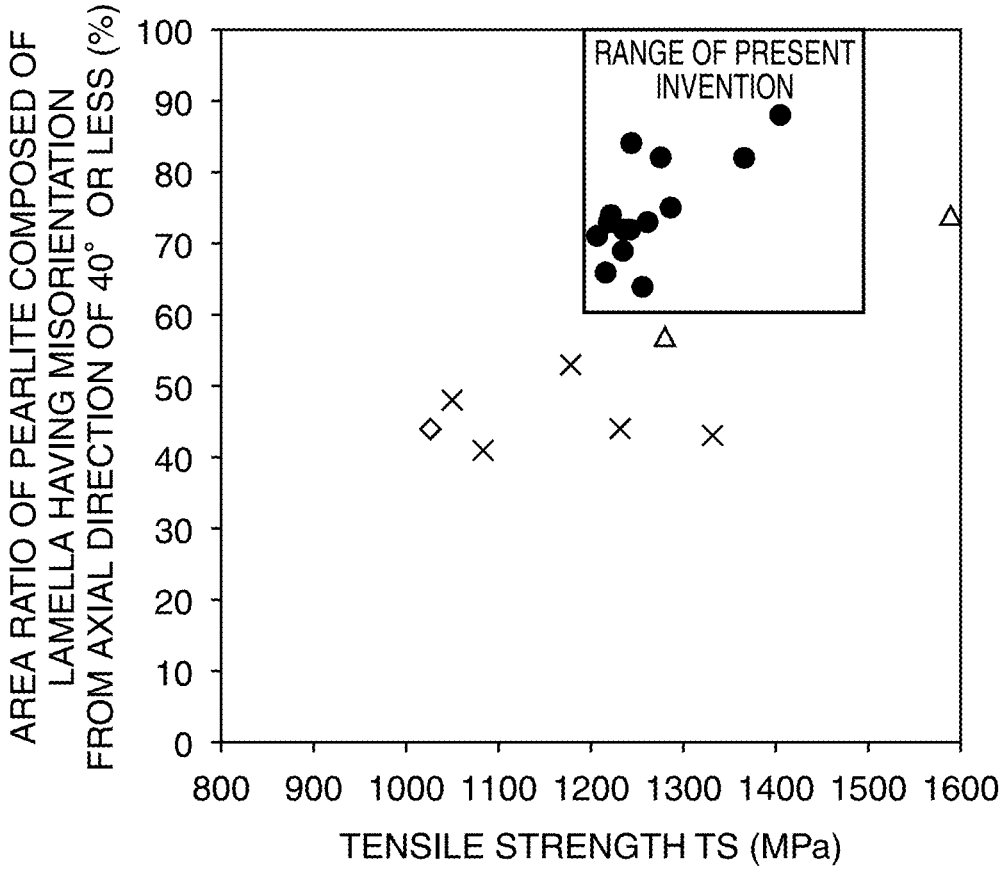
FIG. 2 is a view illustrating a relationship between a tensile strength and an area ratio of pearlite.

FIG. 2 illustrates the relationship between a tensile strength TS and the area ratio of pearlite having an angle between the axial direction and the lamella from the axial direction of 40° or less. It is found that in the standards each satisfying the range of the present invention, the delayed fracture resistance and the cold forgeability are both excellent.

INDUSTRIAL APPLICABILITY

It is possible to utilize the present invention in industries related to, for example, automobile parts, various industrial machine parts, building parts, and so on.

The invention claimed is:

1. A steel wire containing, in mass %:

C: 0.35% to 0.79%;

Si: 0.05% to 2.0%;

Mn: 0.20% to 1.0%; and

Al: 0.005% to 0.05%, a P content being 0.030% or less, a S content being 0.030% or less, and a balance being composed of Fe and inevitable impurities, wherein when a C content is represented by (C %), in a case of (C %) being not less than 0.35% nor more than 0.65%, a volume fraction of pearlite is 64×(C %)+52% or more, and in a case of (C %) being greater than 0.65% and 0.79% or less, the volume faction of pearlite is not less than 94% nor more than 100%, and a structure of the other portion is composed of one or two of proeutectoid ferrite or bainite, in a region up to a depth of 1.0 mm from a surface of the steel wire, a volume fraction of pearlite block having an aspect ratio of 2.0 or more is not less than 70% nor more than 95%, and a volume fraction of pearlite having an angle between an axial direction of the steel wire and a lamellar direction of the pearlite having a layer structure of ferrite and cementite on a cross section parallel to the axial direction of 40° or less is 60% or more with respect to all pearlite, and a tensile strength is 1200 MPa or more and less than 1500 MPa.

2. The steel wire according to claim 1, wherein, in mass %, a N content is 0.0050% or less.

3. The steel wire according to claim 1, further containing, in mass %, one or two of Cr: 0.02% to 1.0% and Ni: 0.02% to 0.50%.

4. The steel wire according to claim 1, further containing, in mass %, one or two or more of Ti: 0.002% to 0.050%, V: 0.01% to 0.20%, or Nb: 0.005% to 0.100%.

5. The steel wire according to claim 1, further containing, in mass %, B: 0.0001% to 0.0060%.

6. The steel wire according to claim 1, further containing, in mass %, one or two or more of Ca: 0.001% to 0.010%, Mg: 0.001% to 0.010%, or Zr: 0.001% to 0.010%.

7. The steel wire according to claim 1, wherein the C content is not less than 0.35% nor more than 0.65%.

8. The steel wire according to claim 1, wherein the C content is greater than 0.48% and 0.79% or less.

9. The steel wire according to claim 1, wherein the C content is greater than 0.48% and 0.65% or less.

* * * * *